United States Patent [19]

Yoshida et al.

[11] Patent Number: 4,716,943

[45] Date of Patent: Jan. 5, 1988

[54] DEVICE FOR CONTROLLING WEFT YARN STORING UNITS FOR JET LOOMS

[75] Inventors: Kazunori Yoshida, Nagoya; Fujio Suzuki; Hidehiko Tanaka, both of Toyota; Susuma Kawabata, Aichi, all of Japan

[73] Assignee: Kabushiki Kaisha Toyota Chuo Kenkyusho, Aichi, Japan

[21] Appl. No.: 831,992

[22] Filed: Feb. 21, 1986

[30] Foreign Application Priority Data

Feb. 21, 1985 [JP] Japan ..... 60-33024

[51] Int. Cl.[4] ..... D03D 47/36; D03D 47/38; B65H 51/20

[52] U.S. Cl. ..... 139/452; 139/453; 242/47.01

[58] Field of Search ..... 139/453, 452, 435; 242/47.01, 47.12, 47.13

[56] References Cited

U.S. PATENT DOCUMENTS

| | | | |
|---|---|---|---|
| 4,326,566 | 4/1982 | Lampaert | 139/453 |
| 4,372,349 | 2/1983 | Van Mullekom | 139/452 |
| 4,397,340 | 8/1983 | Umezawa et al. | 139/452 |
| 4,406,312 | 9/1983 | Egbers et al. | 139/453 |
| 4,529,017 | 7/1985 | Suzuki et al. | 139/452 |
| 4,550,754 | 11/1985 | Iida | 139/452 |
| 4,586,543 | 5/1986 | Volland et al. | 139/452 |

FOREIGN PATENT DOCUMENTS

| | | | |
|---|---|---|---|
| 0151342 | 8/1985 | Japan | 139/452 |

*Primary Examiner*—Harvey C. Hornsby
*Assistant Examiner*—Joseph S. Machuga
*Attorney, Agent, or Firm*—Berman, Aisenberg & Platt

[57] ABSTRACT

In a jet loom in which weft yarns are stored in weft yarn storing units according to a weaving command, and are jetted in the weft insertion cycles thereof, a device for controlling the storing unit comprises: rotation detecting means for detecting the rotational condition of the loom spindle, to output a spindle rotation signal; a rotation control circuit which, according to a weft yarn jetting order, calculates the number of standby cycles between weft insertion cycles, and calculates the speeds of rotation of the storing units to store weft yarns in advance according to the numbers of standby cycle, to output rotation command signals; a drive circuit for receiving the spindle rotation signal and the rotation command signal, to output drives signal to determine the speeds of rotation of the storing units; and drive means provided for the storing unit, each receiving the drive signal to drive the storing unit at a speed of rotation corresponding to the drive signal thus received, a weft yarn as long as a predetermined weft insertion length being stored in the storing units in the weft insertion cycles selected according to the weft yarn jetting order.

11 Claims, 17 Drawing Figures

FIG. 7

| | JETTING NO. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| STORING UNIT A Ch. 1 | SELECTION | | ※ | ※ | | | | | | | | ※ | ※ | | ※ | | ※ |
| | WEFT YARN LENGTH ALLOTMENT | $\frac{\ell}{2}$ | $\frac{\ell}{2}$ | $\frac{\ell}{1}$ | $\frac{\ell}{8}$ | $\frac{\ell}{8}$ | $\frac{\ell}{8}$ | $\frac{\ell}{8}$ | $\frac{\ell}{8}$ | $\frac{\ell}{8}$ | $\frac{\ell}{8}$ | $\frac{\ell}{8}$ | $\frac{\ell}{1}$ | $\frac{\ell}{2}$ | $\frac{\ell}{2}$ | $\frac{\ell}{2}$ | |
| STORING UNIT B Ch. 2 | SELECTION | ※ | | | ※ | ※ | ※ | ※ | ※ | ※ | ※ | | | ※ | | ※ | |
| | WEFT YARN LENGTH ALLOTMENT | $\frac{\ell}{1}$ | $\frac{\ell}{3}$ | $\frac{\ell}{3}$ | $\frac{\ell}{3}$ | $\frac{\ell}{1}$ | $\frac{\ell}{1}$ | $\frac{\ell}{1}$ | $\frac{\ell}{1}$ | $\frac{\ell}{1}$ | $\frac{\ell}{1}$ | $\frac{\ell}{3}$ | $\frac{\ell}{3}$ | $\frac{\ell}{3}$ | $\frac{\ell}{2}$ | $\frac{\ell}{2}$ | |

FIG. 8

| | JETTING NO. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| STORING UNIT A Ch. 1 | SELECTION | | ※ | ※ | | | | | | | | ※ | ※ | | ※ | | ※ |
| | WEFT YARN LENGTH ALLOTMENT | $\frac{\ell}{2}$ | $\frac{\ell}{2}$ | $\frac{\ell}{1}$ | $\frac{\ell}{6}$ | $\frac{\ell}{6}$ | $\frac{\ell}{6}$ | $\frac{\ell}{6}$ | $\frac{\ell}{6}$ | $\frac{\ell}{6}$ | 0 | 0 | $\frac{\ell}{1}$ | $\frac{\ell}{2}$ | $\frac{\ell}{2}$ | $\frac{\ell}{2}$ | $\frac{\ell}{2}$ |
| STORING UNIT B Ch. 2 | SELECTION | ※ | | | ※ | ※ | ※ | ※ | ※ | ※ | ※ | | | ※ | | ※ | |
| | WEFT YARN LENGTH ALLOTMENT | $\frac{\ell}{1}$ | $\frac{\ell}{3}$ | $\frac{\ell}{3}$ | $\frac{\ell}{3}$ | $\frac{\ell}{1}$ | $\frac{\ell}{1}$ | $\frac{\ell}{1}$ | $\frac{\ell}{1}$ | $\frac{\ell}{1}$ | $\frac{\ell}{1}$ | $\frac{\ell}{3}$ | $\frac{\ell}{3}$ | $\frac{\ell}{3}$ | $\frac{\ell}{2}$ | $\frac{\ell}{2}$ | |

FIG. 15

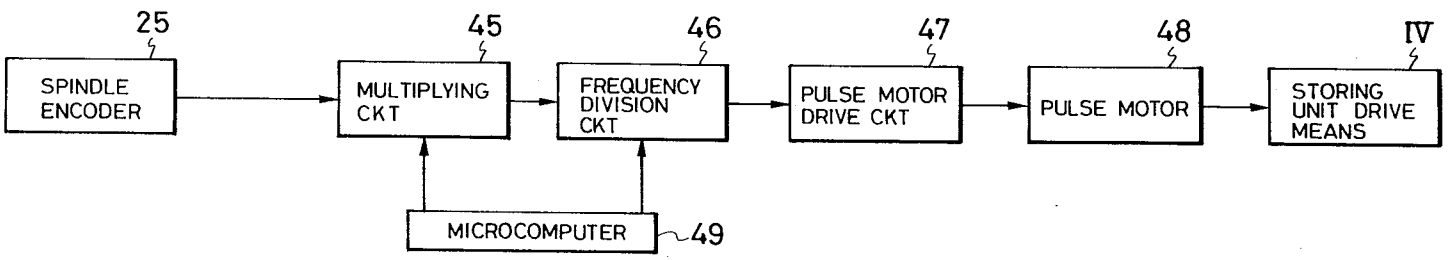

FIG. 16

| JETTING NO. | | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| STORING UNIT A Ch. 1 | SELECTION | | ※ | ※ | | | | | | | | ※ | ※ | | ※ | | ※ |
| | WEFT YARN LENGTH ALLOTMENT | $\frac{2l}{3}$ | $\frac{2l}{3}$ | $\frac{2l}{3}$ | $\frac{2l}{9}$ | $\frac{2l}{9}$ | $\frac{2l}{9}$ | $\frac{2l}{9}$ | $\frac{2l}{9}$ | $\frac{2l}{9}$ | $\frac{2l}{9}$ | $\frac{2l}{9}$ | $\frac{2l}{9}$ | $\frac{2l}{4}$ | $\frac{2l}{4}$ | $\frac{2l}{4}$ | $\frac{2l}{4}$ |
| STORING UNIT B Ch. 2 | SELECTION | ※ | | | ※ | ※ | ※ | ※ | ※ | ※ | ※ | | | ※ | | ※ | |
| | WEFT YARN LENGTH ALLOTMENT | $\frac{2l}{4}$ | $\frac{2l}{4}$ | $\frac{2l}{4}$ | $\frac{2l}{4}$ | $\frac{2l}{2}$ | $\frac{2l}{2}$ | $\frac{2l}{2}$ | $\frac{2l}{2}$ | $\frac{2l}{2}$ | $\frac{2l}{2}$ | $\frac{2l}{5}$ | $\frac{2l}{5}$ | $\frac{2l}{5}$ | $\frac{2l}{5}$ | $\frac{2l}{5}$ | |

DEVICE FOR CONTROLLING WEFT YARN STORING UNITS FOR JET LOOMS

BACKGROUND OF THE INVENTION

1. Technical Field

This invention relates to jet looms, and more particularly a device for controlling a plurality of weft yarn storing units for a jet loom which are adapted to selectively store a plurality of weft yarns.

2. Description of the Prior Art

A weft yarn storing unit for selecting and jetting free weft yarns, which comprises a motor and a storing mechanism as shown in FIG. 2, is well known in the art. The construction and operation of the unit will be described.

Before being jetted, a weft yarn from a package 1 is passed through a hollow shaft 2 rotated by a motor (not shown) and an arm 4 rotated together with the shaft 2, and wound on a drum 5 which is fixed by a magnet 9. At the weft yarn jetting timing, a solenoid is operated to disengage a pin 6 from the drum 5, and the weft yarn is unwound and inserted into the warp shed by the pneumatic force of a main nozzle. A sensor 7 for detecting the unwinding of a weft yarn is disposed beside the pin 6. When the number of times of unwinding corresponding to a woven fabric width is counted, the solenoid is deenergized and the pin 6 is inserted into a hole formed in the drum 5. As the weft yarn is jetted, the quantity of weft yarn wound on the drum is decreased. The remaining quantity of weft yarn on the drum is detected by an optical sensor 8, so that the motor coupled to the shaft 2 is started to supply the weft yarn.

A plurality of weft yarn storing units which are constructed as described above are set. The units thus set are suitably operated in association with the main nozzles to insert a plurality of weft yarns different in color.

In the above-described unit, theoretically a weft yarn can be selected freely. However, the practical use of the unit suffers from the following two problems: The first problem resides in the power of drive means, or motor. That is, in the conventional unit, the motor is rotated according to the quantity of yarn wound on the drum instead of the rotational condition of the loom body. Therefore, even in the case where two weft yarn storing units are alternately operated to jet two weft yarns different in color, the motors of the units repeatedly carry out an on-off operation in such a manner that as the quantity of yarn on the drum is decreased, the yarn is supplied for supplement. Therefore, the power consumption required for starting and stopping the motors is increased, and the amount of heat generated by the motors is also increased. If, in the case of alternately inserting two weft yarns different in color, the rpm of each motor is set to ½ of the rpm which is required when one weft yarn is inserted, then the above-described starting and stopping operations can be eliminated. In view of the foregoing, in order to decrease the frequency of on-off operations, a method has been employed in which the average weft insertion rate (weft insertion length per minute) of each weft yarn storing unit, and the rpm of the motor is manually adjusted according to the weft insertion rate. However, the method is disadvantageous in that the amounts of yarn wound on the drums change according to the jetting order, thus greatly increasing depending on the jetting order. Ideally, the quantity of yarn for only one weft insertion should be stored on the drum. However, if, in the case where the average value of the weft insertion rate is calculated and the rpm of the motor is set for the average weft insertion rate, the rpm of the motor is set to a half (½) of the rpm required for the continuous insertion of one yarn when the units are alternately operated to insert ten yarns each time, the unit which jets ten times earlier should store the quantity of yarn corresponding to five jetting operations, otherwise the quantity of yarn becomes short during operation. If, in order to eliminate this difficulty, an excessive amount of yarn is wound on the drum, then the yarns may tangle with each other, the yarn may be wound unsatisfactorily, and the unit itself is increased in size. As is apparent from the above description, the conventional unit suffers from the problem that fundamentally the power of the motor is not economically used. Solution of the problem would lower the reliability of the unit.

The second problem accompanying the conventional unit resides in the erroneous operation of the sensor 8. The sensor 8 is to determine whether or not the yarn is wound a predetermined number of turns on the drum. The sensor 8 is generally a reflection type photo-electric converter such as a photo-diode. Therefore, the sensor is liable to operate erroneously in the case where the yarn is thin or colored, for instance, in black; that is, in the case where it is optically difficult to detect the yarn. Furthermore, the erroneous operation may attribute to the mechanical reason that, for instance, the yarn is irregularly wound on the drum. The fact that the sensor essential for motor control is low in reliability is a serious drawback of the conventional unit. Accordingly, for stably storing the yarn, it is required to provide a weft yarn storing unit which needs no such stored-yarn-detecting sensor.

SUMMARY OF THE INVENTION

Accordingly, an object of this invention is to eliminate the above-described difficulties accompanying a conventional weft yarn storing unit.

More specifically, an object of the invention is to provide a device for controlling a plurality of weft yarn storing units for jet looms, in which the storage control means is improved best, thereby to eliminate the uneconomical use of an electric motor to drive each weft yarn storing unit and erroneous weft yarn storing operations, whereby the control is most suitable for the preparation for weft insertion.

The foregoing object and other objects of the invention have been achieved by the provision of a device for controlling a plurality of weft yarn storing units for a jet loom in which a plurality of weft yarns are stored in the respective weft yarn storing units according to weaving pattern command signals, and in the weft insertion cycle of each weft yarn storing unit the weft yarn stored therein is jetted to the loom to perform a weft insertion, which device, according to the invention, comprises: rotation detecting means for detecting a rotational condition of the spindle of a loom body, to output a spindle rotation signal; a rotation control circuit which, according to a weft yarn jetting order command signal, calculates the numbers of standby cycles between weft insertion cycles of the weft yarn storing units, and calculates the speeds of rotation of the weft yarn storing sections in the weft yarn storing units to store weft yarns for weft insertion in advance according to the numbers of standby cycles thus calculated, to output rotation command signals; a drive circuit for receiving the spindle rotation signal from the rotation detecting means and the rotation command signals from the rotation control circuit, to output drive signals to determine the speeds of rotation of the weft yarn storing unit; and drive means provided for the weft yarn storing units, respectively, each drive means receiving the drive signal from the drive circuit, to drive the weft yarn storing section of the respective weft yarn storing unit at a speed of rotation corresponding to the drive signal thus received, a weft yarn having a length corresponding to a predetermined weft insertion length being stored in each weft yarn storing unit in a weft insertion cycle selected according to the weft yarn order command signal.

The nature, principle and utility of the invention will become more apparent from the following detailed description when read in conjunction with the accompanying drawings.

BRIEF DESCRIPTION OF THE DRAWINGS

In the accompanying drawings

FIGS. 7 and 8 are tables indicating examples of a weft yarn length allotment for weft yarn storing units according to the invention, respectively;

FIG. 15 is a block diagram showing a control system in another embodiment of the invention;

FIG. 16 is a table indicating the allotment of a predetermined weft yarn length to weft yarn storing units in the embodiment of FIG. 15.

DETAILED DESCRIPTION OF THE INVENTION

Figure 1:
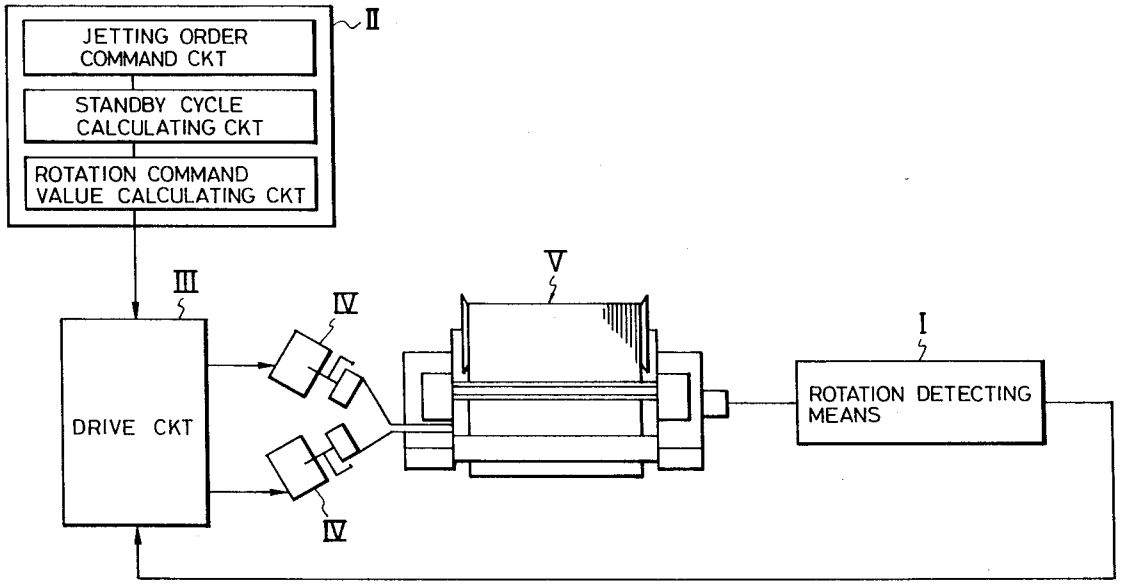
FIG. 1 is an explanatory diagram, partly as a block diagram outlining the arrangement of a device for controlling weft yarn storing units in a loom according to this invention.

In a first aspect of this invention, a rotation control circuit calculates, where a weft insertion length corresponding to a weaving width of a loom is represented by l, the number of set storing cycles is represented by n (n being an integer larger than zero) and the calculated number of standby cycles of a weft yarn storing unit is represented by Si, the speed of rotation of a weft yarn drive section of the weft yarn storing unit which uniformly allots a weft yarn length nl stored before the following weft insertion over cycles which are determined from the sum $$\left(\sum_{i=1}^{n} Si + n\right)$$

of the number of standby cycles and the number of set storing cycles, to output a rotation command signal. The set storing cycles (n) represent the quantity of a weft yarn to be stored, which is represented by the number of insertions of the weft yarn.

The standby cycles ($S_i$) represent the number of non-jetting cycles between weft yarn insertions during which no weft yarn insertion is carried out.

In the first aspect, the drive means for the weft yarn storing units are controlled according to the weft insertion order of the loom body. Each weft yarn storing unit operates to store a weft yarn before a weft insertion. Examples of the storing unit are an air pool device in which the flow of air is utilized to store a weft yarn in the form of the character "U", and a drum device in which a weft yarn is wound on a cylindrical drum with the aid of an arm or roller.

Let us consider the case where the weaving width is represented by l, and a weft yarn is wound on a drum having a diameter d for the purpose of storing it. In this case, in order to wind a weft yarn of length l corresponding to one weft insertion on the drum, it is necessary to rotate the drum $l/\pi d$ times. It is assumed that this number of times of rotation is represented by a. Then, in the case where the weft yarn is continuously pulled out of the storing unit for weft insertion, the weft yarn should be wound on the drum a turns for each cycle of the loom. In the case where the weft yarn is jetted every other cycle, the weft yarn should be wound on the drum in such a manner that the number of turns per cycle is a/2 over a non-jetting cycle, i.e., a standby cycle of the storing unit, and a jetting cycle.

In the case where the jetting order is simple as described above, the loom body can be coupled to the storing unit under a certain coupling condition by using coupling means such as a gear train or timing pullers. However, this method cannot be applied to the case where, for instance, a number of weft yarn storing units are provided for one loom and the weft yarns thereof are jetted at random.

In the first aspect of the invention, in determining the speeds of storage of the storing units and accordingly in alloting the storage length for each cycle of the loom, the quantities thereof to be alloted to the storing units are calculated from the number of cycles in which the storing units are kept in standby state, i.e., the number of non-jetting cycles, for the purpose of controlling the drive means of the storing units. This is equivalent to the operation that the speed change ratio of the aforementioned gear train or timing pulleys is instantaneously switched, according to the jetting order, at the time when the cycle of the loom is changed. It goes without saying that it is impossible for the gear train or timing pulleys to perform such an operation. In the invention, the switching operation is realized by using an electrical control circuit, and a speed change mechanism is employed instead of the gear train or timing pulley means, so that the weft yarn storing units can be suitably driven for random insertion of a plurality of weft yarns different in color.

In FIG. 1, rotation detecting means I is to detect rotation of a loom body, and includes a detector and a signal processing circuit, and a rotation control circuit II comprises a jetting order command circuit, a standby cycle calculating circuit, and a rotation command value calculating circuit.

The jetting order command circuit is to store the jetting order of weft yarn storing units, and can be realized by a semiconductor memory, tape or card. The standby cycle calculating circuit is to read the content of the command thereby to calculate the number of standby cycles. The rotation command value calculating circuit operates to calculate allotment data according to the number of standby cycles, thereby to perform the allotment operation.

The case where four weft yarns different in color are inserted in the warp shed by way of example and one weft insertion length is represented by l (the number of set storing cycles n=1) will be described. It is assumed that four weft yarn storing units A, B, C and D are operated in the order of B, A, C, D, A, B, C, C, D, A, B, B, . . . to jet the weft yarns. In the case of the storing unit A, in the first cycle the storing unit A does not jet the weft yarns, and in the second cycle it does. Therefore, in the first cycle the storing unit A stores the weft yarn as long as ½ of l, and in the second cycle it stores the weft yarn as long as ½ of l. Then, the storing unit A is held in standby state until it jets the weft yarn, i.e., the storing unit A is held in standby state for two cycles and jets the weft yarn in the third cycle. In this case, the storing unit A stores the weft yarn as long as ⅓ of l in each of the three cycles.

That is, if the number of non-jetting cycles is represented by S, then the operation of winding a weft yarn as long as l/(S+1) is repeated over (S+1) cycles. In the case of the storing unit B, the latter jets the weft yarn in the first cycle, and therefore it stores the weft yarn as long as l/1 in the first cycle. Then, the storing unit B does not jet the weft yarn in the following four cycles, and jets the weft yarn in the fifth cycle, therefore the storing unit B stores the weft yarn as long as l/5 in each of the five cycles. As is apparent from the above description, the storing yarn length is alloted with the sum of one (1) and the number of non-jetting cycles between jetting cycles as the denominator thereof.

In the above-described operation, n=1 in the allotment of one weft yarn insertion length l. Now, a more general allotment operation will be described. In the operation, the method of alloting a weft yarn length for one weft insertion is modified into a method of alloting a weft yarn length corresponding to n weft insertions.

If the standby cycles of weft yarn storing units are represented by S1, S2, S3, . . . and Si, then the total number of cycles which occur until the n-th jetting cycle is $$\sum_{i=1}^{n} Si + n.$$

In the case of n=1, the total number of cycles is $S_1+1$. In the case of n=2; that is, in the case of storing a weft yarn length for two weft insertions, the allotment is effected over (S1+S2+2) cycles. If a weft yarn length for n weft insertions is equally alloted over $$\left(\sum_{i=1}^{n} Si + n\right)$$

cycles, then as n increases, the frequency of speed change of the drive means is decreased as much and accordingly the storing operation is smoothly carried out.

The weft yarn allotment has been described with respect mainly to the rotation control circuit II in FIG. 1 which is one of the specific features of the first aspect of the invention. The above-described operation of the rotation control circuit controls the drive circuit. And the drive means control the speeds of rotation of the weft yarn storing sections of the weft yarn storing units according to the number of standby cycles and the number of set storing cycles so that the weft yarn is equally stored in each cycle.

In a second aspect of the invention, the rotation control circuit, when the sum $$\left(\sum_{i=1}^{n} Si + n\right)$$

of the number of standby cycles and the number of set storing cycles exceeds the upper limit number S′ of cycles for uniform allotment predetermined, calculates and outputs the speeds of rotation of the weft yarn storing units which store a weft yarn length ln in the weft yarn storing sections thereof during S′ cycles, and after S′ cycles, outputs signals to stop the weft yarn drive sections.

In the second aspect of the invention, in the case where the uniform allotment of weft yarn is effected over cycles more than the upper limit number S′; i.e., weft insertion command signals are extremely seldomly applied to particular weft yarn storing units, the phenomenon that the weft yarn storing sections of the weft yarn storing units are continuously driven at low speed is prevented, and a weft yarn having a predetermined length is stored in S′ cycles, and thereafter the weft yarn storing sections are stopped until the next weft insertion command signal is outputted, whereby the operation of the control circuit is made simple, it is made unnecessary to employ expensive drive means which are high both in resolution and in accuracy.

The upper limit number S′ of cycles can be determined according to the following two methods: (1) In the first method, the minimum number of revolutions per minute is determined from the range of stable rotation of the motor, and according to the minimum number of revolutions per minute thus determined and weft insertion conditions the value S′ is determined. (2) In the second method, the value S′ is determined from the weft insertion conditions of the loom. One of the two methods should be selected as the case may be.

In a third aspect of the invention, the drive circuit compares a spindle rotation signal with a storing rotation signal, and outputs a drive signal according to the difference between the two signals, thus feedback-controlling the weft yarn storing units in such a manner that a weft yarn having a predetermined weft insertion length is stored in cycles selected by a weft yarn jetting order signal stored in a memory device.

In the third aspect, the speed of rotation of the spindle of the loom body and the speed of rotation of a weft yarn storing section are detected. According to the difference of the speeds of rotation thus detected, the speed of rotation of a weft yarn storing section is feedback controlled resulting in improved weft yarn storage control accuracy. Furthermore, employment of the speed control system makes it unnecessary to use expensive servo systems as the drive means, and makes it possible to use the sensor and the control circuit which are relatively low in manufacturing cost. Thus, the effect should be highly appreciated in the case where a number of weft yarn storing units are operated.

In a fourth aspect of the invention, the rotation detecting means comprises a shaft encoder which is coupled through rotation to the spindle of the loom body and the weft yarn storing sections of the weft yarn storing units, to generate an electrical pulse for every predetermined angular rotation of the spindle, the drive circuit comprises a control circuit for converting the frequency of a pulse signal from the shaft encoder, to control the speeds of rotation of the weft yarn storing units, and the rotation control circuit controls the frequency conversion ratio of the drive circuit according to the rotation command signal based on the weft yarn jetting order command signal.

In the fourth aspect, the rotation detecting means, the rotation control circuit, and the drive circuit are operated in digital mode, whereby the occurrence of errors attributing to drift or the like is prevented, with the result that the weft yarn storage control is improved in accuracy. The rotation control circuit includes a jetting order command circuit for outputting signals of weft yarn jetting order command, a standby cycle calculating circuit for calculating the numbers of standby cycles between weft insertion cycles of said weft yarn storing units according to a weft yarn jetting order command signal, and a rotation command amount calculating circuit for calculating the speeds of rotation of weft yarn storing sections in said weft yarn storing units to store weft yarns for weft insertion in advance according to the numbers of standby cycles thus calculated.

FIRST EMBODIMENT

In a first embodiment of this invention, two drum type storing units are employed, an optical rotary encoder is provided, as a rotation detecting circuit I for detecting a rotational position, for a loom body V, a rotation control circuit II comprising a microcomputer is used to operate a rotation command for each storing means, and according to the rotation commands encoder signals are subjected to frequency division. With the aid of the resultant signals, the speeds of drive means IV, namely, two servo motors are changed, to perform the operation of storing two weft yarns different in color.

Figure 3:
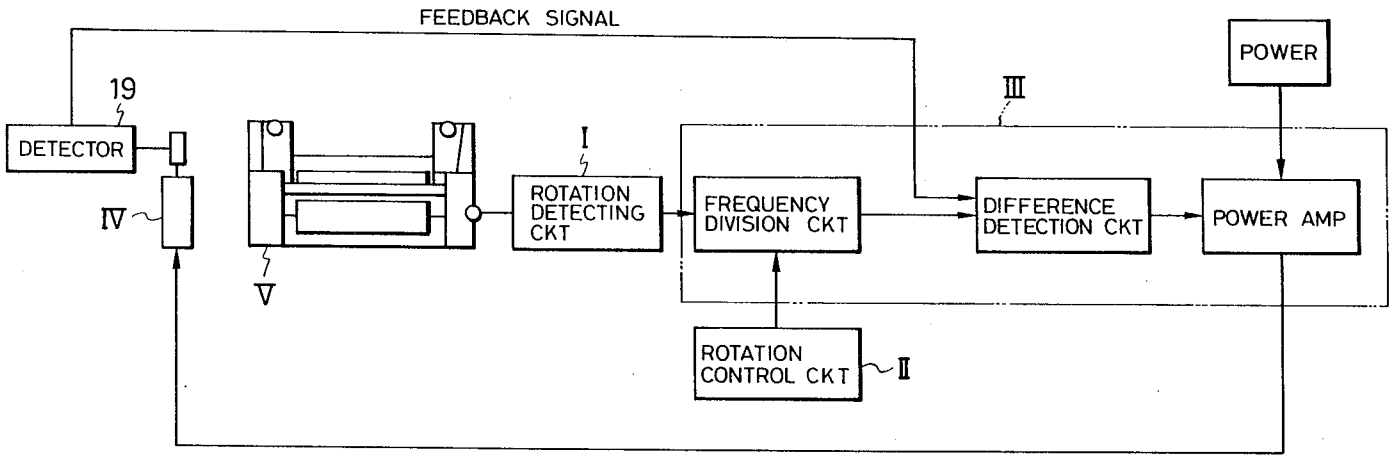
FIG. 3 is a block diagram showing a control system in one embodiment of the invention.

FIG. 3 is a block diagram showing one storing unit. As shown in FIG. 3, a detector 19 for detecting an amount of rotation from a rotational angle is provided for drive means IV, and the output signal of the detector is used as a feedback signal to a drive circuit III. In addition, digital means are employed as essential elements in the drive circuit III, to improve the storage accuracy.

Figure 2:
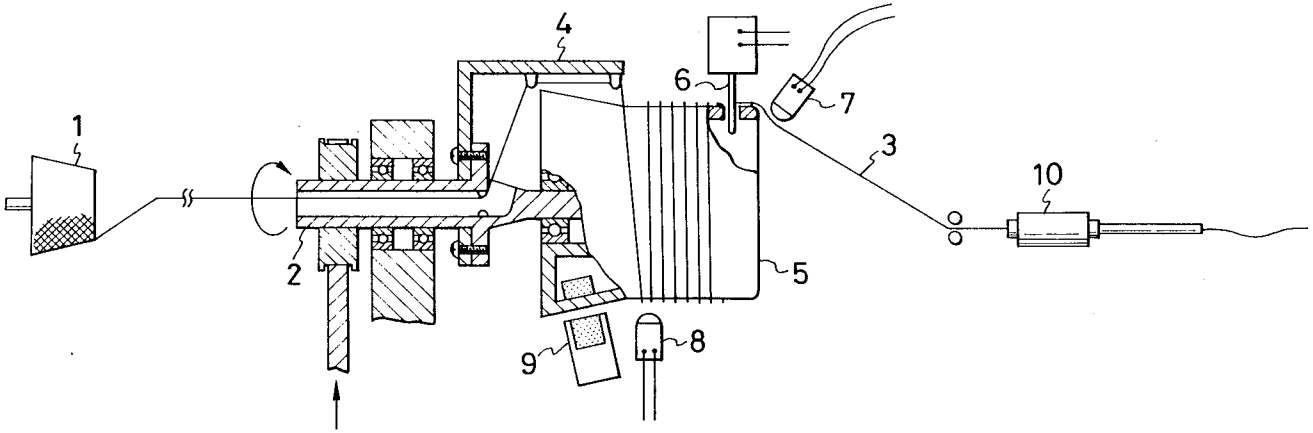
FIG. 2 is a front view, with parts cut away or sectioned, showing one example of a conventional weft yarn storing unit.

The elements of the storing unit will be described with reference to FIGS. 4 through 11. The main components of the storing unit illustrated are constructed on the same principle as those in FIG. 2. And parts corresponding functionally to those already described with reference to FIG. 2 are therefore designated by the same reference numerals or characters.

Figure 4:
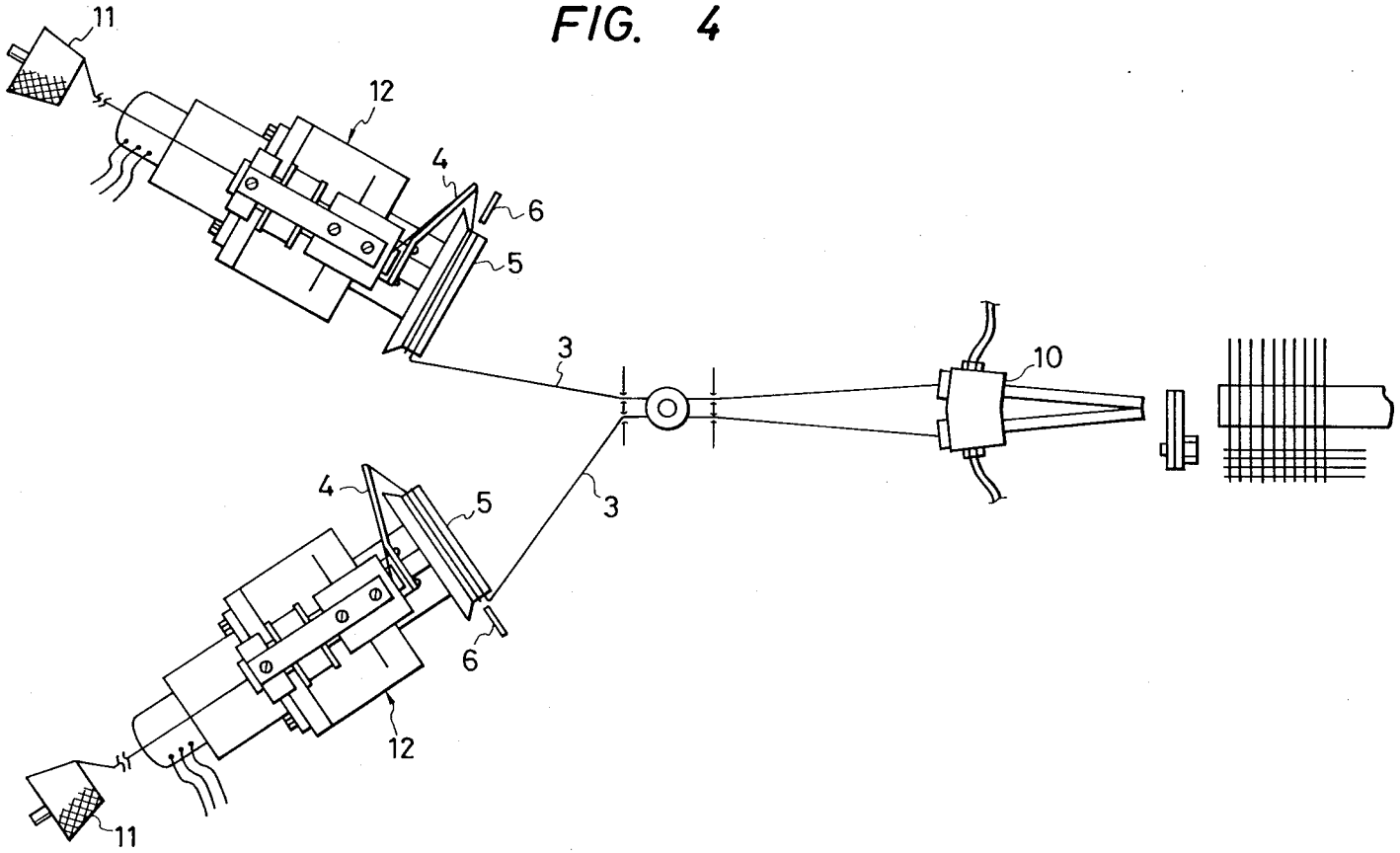
FIG. 4 is a top view showing one example of the arrangement of weft yarn storing units in the invention.

FIG. 4 is a plan view showing the arrangement of two storing units. Each storing unit 12 has a drum 5 held at rest, and an arm 4 adapted to rotate around the drum 5. The arm 4 pulls a weft yarn 3 out of a package 11 and winds it on the drum 5, thus storing the weft yarn while measuring its length. The two storing units 12 and 12 are arranged radially as illustrated, to decrease the resistance of yarn in jetting the yarns.

Figure 5:
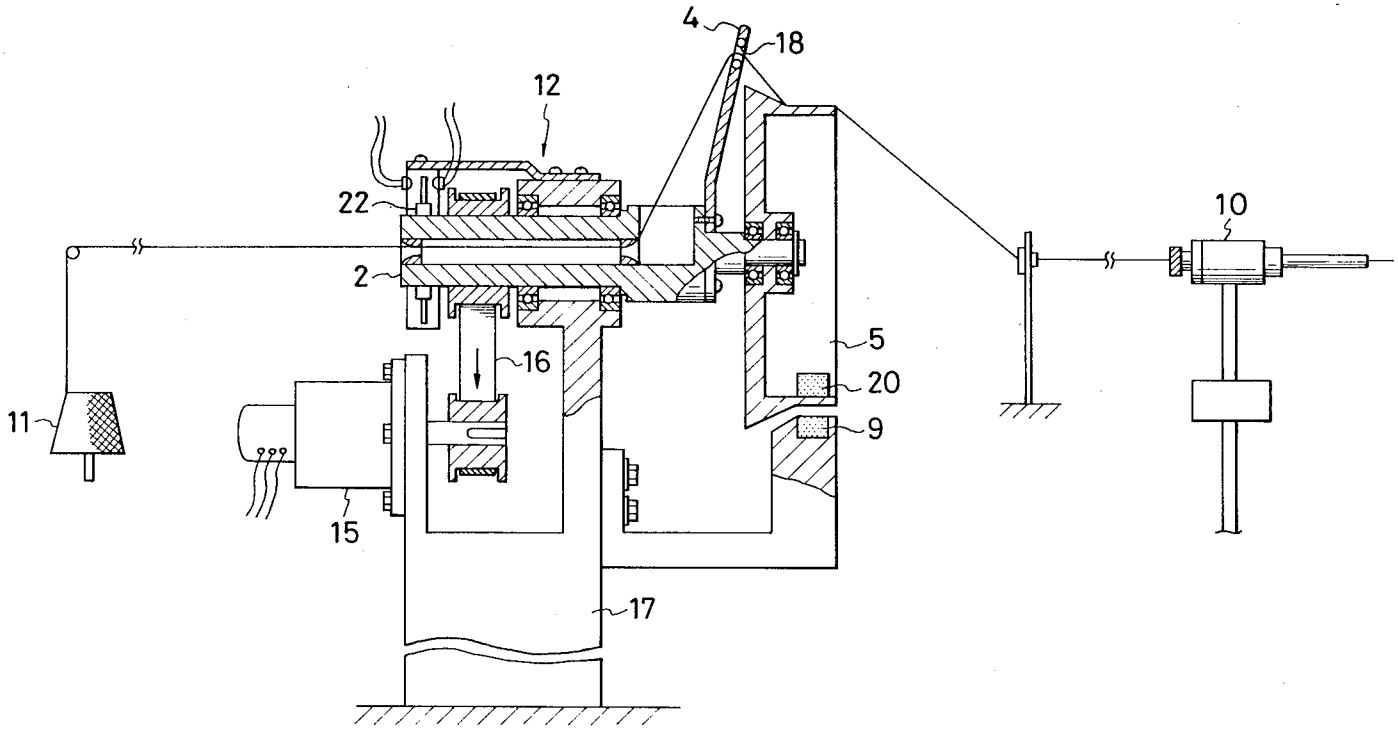
FIG. 5 is a front view, with parts cut away or sectioned, showing one of the weft yarn storing units in FIG. 4.

FIG. 5 is a front view, with parts cut away, showing each storing unit in detail. As shown in FIG. 5, a motor 15 is mounted on a foundation 17, and the rotation of the motor 15 is transmitted through a belt 16 to a hollow shaft 2. The drum 5 is rotatably mounted through bearings on the end portion of the hollow shaft 2. The arm 4 has a threading hole 18, and is secured to the end portion of the shaft 2. As the arm 4 is rotated, the weft yarn is wound on the drum 5 which is kept stopped by the force of attraction between a magnet 9 secured to the foundation 17 and a magnet 20 provided on the drum 5. The length of the circumference of the drum 5 is 1/a of the weaving width (where a is the integer), and a revolution of the arm 4 corresponds to a storing operation for one weft insertion.

An optical shaft encoder 22 is mounted, as the detecting device 19 in FIG. 3, on the shaft 2. The encoder 22 comprises a light source, a photo-detector, and a slit disk, to produce an electrical pulse train with rotation of the arm.

Figure 6:
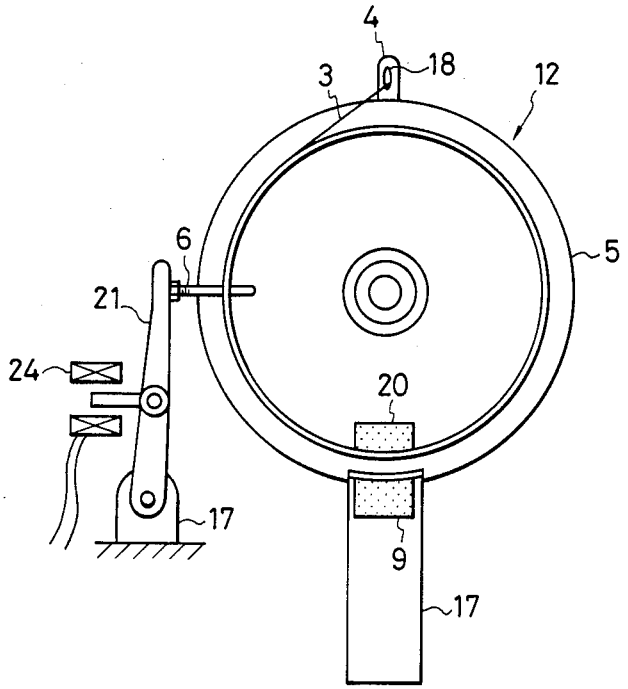
FIG. 6 is a side view showing essential parts of the weft yarn storing unit in FIG. 5.

FIG. 6 is a side view of the storing unit of FIG. 5, showing a pin mechanism which causes the weft yarn 3 to leave from the drum with the timing of weft insertion. The weft yarn 3 is allowed to leave from the drum 5 by disengaging the pin 6 from the hole formed in the cylindrical wall of the drum 5. A lever 21 is mounted on the foundation 17 in such a manner that it is swingable about its one end. The lever 21 has the pin 6 at the other end, and a solenoid 24 is provided near the middle of the lever 21 so as to swing the lever 21 thereby to move the pin 6 into and out of engagement with the hole of the drum.

The principle of a drive circuit for the motor 15 will be described, and then the arrangement and operation of the drive circuit will be described.

Let us consider the case where two weft yarns are employed, and the weft yarn jetting order is in a pattern of B, A, A, B, B, B, B, B, B, B, A, A, B, A, B and A, where the jetting pattern A is intended to mean that the yarn of one (A) of the two storing units 12 and 12 is selected, and B, to mean that the yarn of the other (B) is selected. The fundamental operation of the embodiment is that, as shown in FIG. 7, the length measurement is carried out with a length of yarn l alloted at shares of l/N every loom cycle (where l is one weft insertion length, and N is the value obtained by adding one (1) to the number of times of non-selection (S) of each storing unit). This operation corresponds to the operation of switching a spindle and an arm shaft with a gear train having a speed increase ratio 1/N each cycle. This system will be referred to as "an 1/N system", when applicable. The specific feature of the system resides in its rationality; that is, the system is advantageous in that it can handle any jetting order and its operation can be readily understood. However, realization of this operation would result in a difficulty. That is, for instance in the case where one of the storing units is rarely selected, the value N is considerably large. Therefore, when the 1/N system is effected with a servo circuit, a difficulty is involved in the aspect of software and hardware. Therefore, it is rational that, in the case where the non-jet period is long, the value N is set to a suitable value, 1/N is repeated N times, and the arm 4 is stopped. An allotment system including the stopping of the arm will be referred to as "an (1/N+O) system", when applicable.

FIG. 8 shows allotment ratios in the case where the maximum value of N is six (6). The figure "O" is provided for jet numbers "10" and "11", in FIG. 8. It goes without saying that the figure "O" may be provided for any one of the jet number "4" through "11"; however, it is preferable that the figures "O" are collectively provided in the rear part as shown in FIG. 8, thereby resulting in making software simple or easy. Upon high speed insertion of weft yarn, the rotation speed of the arm varies abruptly between the jet numbers "3" and "4" or "11" and "12", and therefore if it is expected that undesired cutting of the weft yarn might occur, weft yarn length allotment between the jet numbers "4" and "11" may be determined to 1/3, 1/6, 0, 0, 0, 0, 1/6, 1/3 so that the rotation speed of the arm would vary smoothly.

The 1/N system, and the (1/N+O) system, the embodiment, are of a positioning servo system which receives the amount of rotation of a loom as its input, and can employ a DC or AC servo motor as the arm shaft drive means IV.

Figure 9:
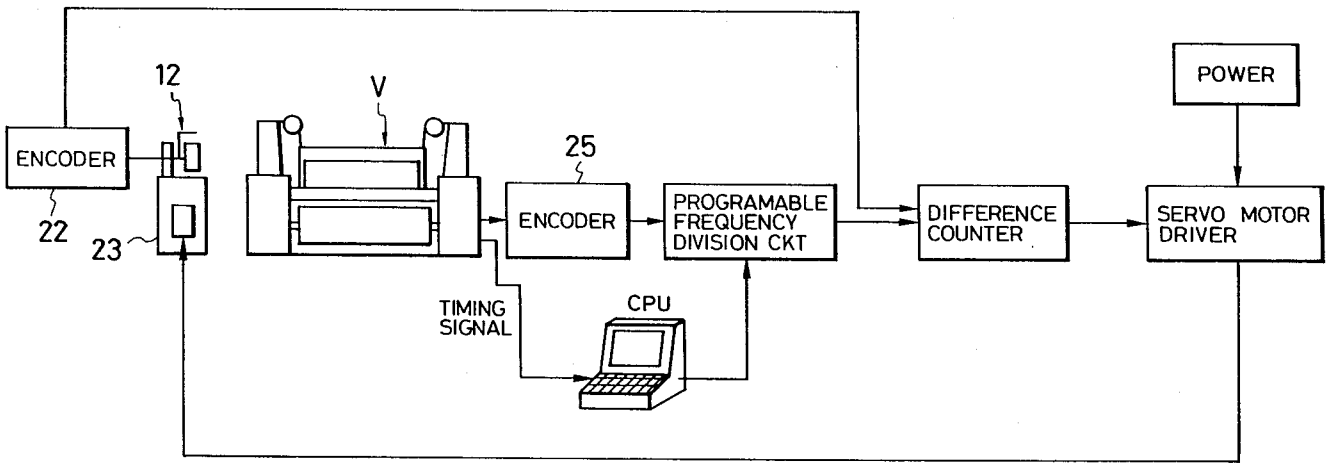
FIG. 9 is an explanatory diagram, partly as a block diagram, showing a control system in another embodiment of the invention.
Figure 10:
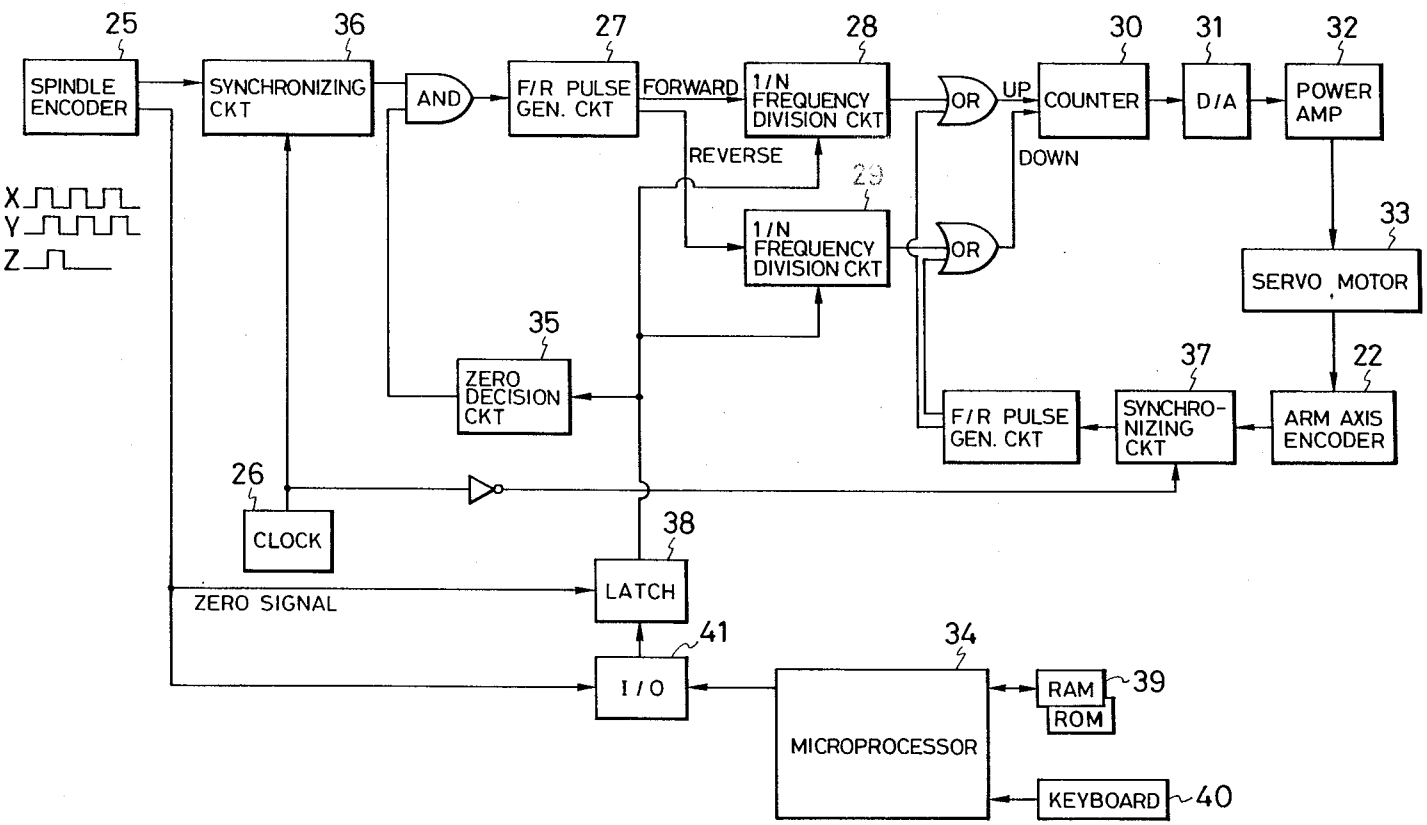
FIG. 10 is a block diagram showing essential elements in FIG. 9.

FIG. 9 is a diagram showing the entire arrangement with a servo motor 33 employed as the arm drive means. FIG. 10 is a block diagram showing an electrical control circuit of the (1/N+O) system shown in FIG. 9.

In FIG. 10, reference numeral 25 designates an encoder coupled to the spindle of a loom V. The encoder produces a square wave X, a signal Y which lags the square wave X by a phase angle of 90°, and a reference zero signal Z. A clock circuit 26 provides a clock signal whose frequency is five to ten times as high as those of the signals X and Y. The clock signal thus produced is used to synchronize the signals X and Y. A forward and reverse pulse generating circuit 27 determines whether the spindle is rotated in the forward direction or in the reverse direction, to provide a forward pulse or a reverse pulse. The forward and reverse pulses are applied to 1/N frequency division circuits 28 and 29, respectively. The outputs of the 1/N frequency division circuits 28 and 29 are applied respectively through OR circuits to an up-down counter 30. The output of the up-down counter 30 is applied through a D/A converter circuit 31 to a power amplifier 32, where it is subjected to power amplification to drive the servo motor 33.

In the 1/N frequency division circuits 28 and 29, the value N is externally programmable and is outputted by a microprocessor 34. If an encoder is used for each storing unit which is such that the ratio of the number of pulses generated per revolution of the arm shaft by the encoder 22 mounted on the shaft 2 which is the arm shaft of the arm 4 to the number of pulses produced by the spindle encoder 25 coupled to the spindle of the loom V is 1:a, then the servo system operates so that, with N=1, the number of revolutions of the arm shaft is just a times the number of revolutions of the spindle.

When N is O, a zero decision circuit 35 operates, as a result of which the output of the spindle encoder 25 is not applied to the counter, and therefore the servo motor 33 is stopped. The synchronizing circuits 36 and 37 are to prevent the simultaneous application of the pulses to the counter. A latch circuit 38 is provided to renew the value N at the instant of application of the signal Z thereto.

The jetting order is stored in a memory 39 by operating a key board 40. In the microprocessor, the denominator N of the allotment ratio and the figure O indicated in FIG. 8 are utilized for calculation, and the result of calculation is applied through an I/O circuit 41 to the latch circuit 38. Therefore, the software thereof is considerably simple, which is one of the significant features of the embodiment.

Figure 11:
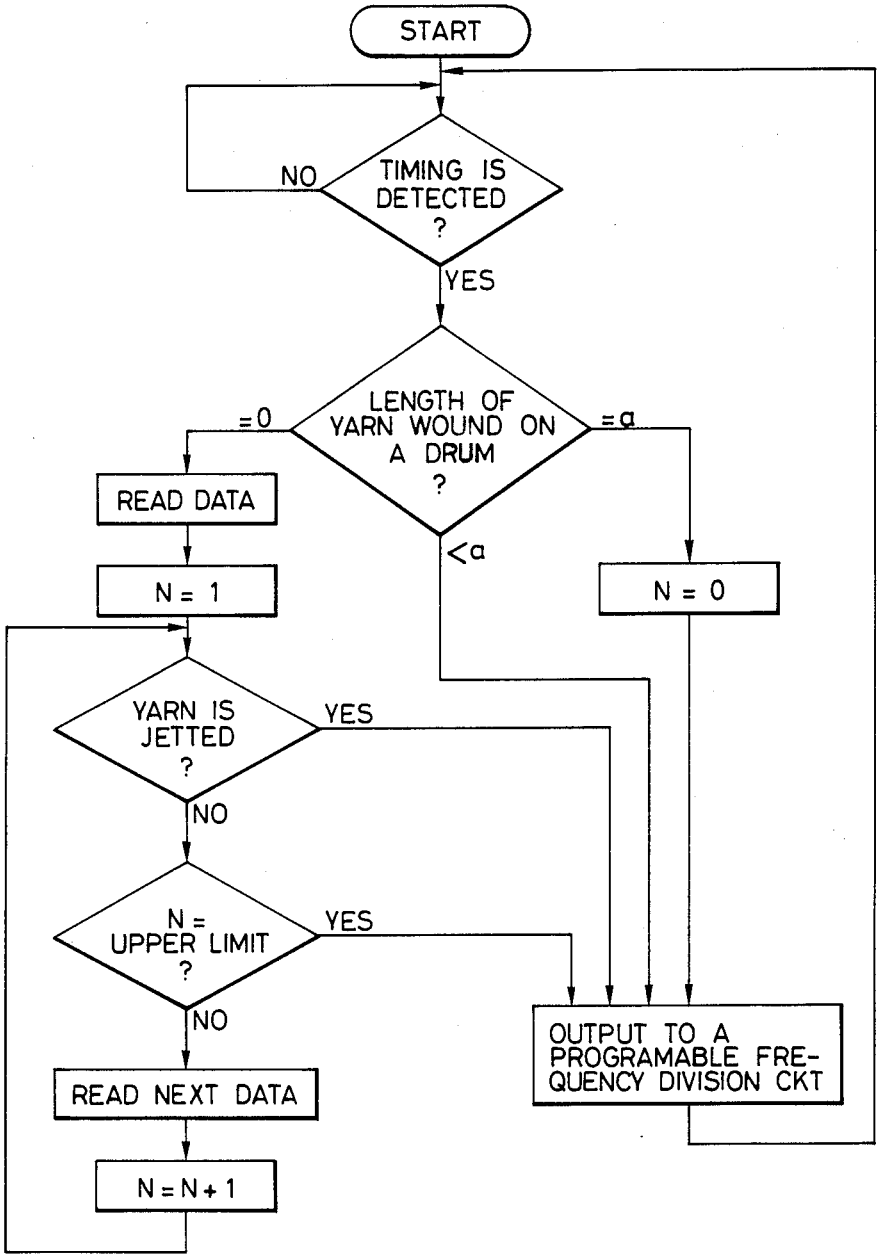
FIG. 11 is a flow chart for a description of the operation of the circuit shown in FIG. 10.

The fundamental software of the microcomputer forming the rotation control circuit II will be described with reference to a flow chart shown in FIG. 11.

It is assumed that the jetting order has been stored in the memory through the I/O circuit 41. First, the timing of the spindle is detected, thereby to determine whether the timing of the loom body has reached a predetermined value or not. For the timing, a crank angle of 270° to 300° is suitable with which the weft insertion is accomplished.

After the timing has been detected, the length of a yarn wound on the drum 5 is calculated by utilizing the past results of the servo system which have been stored in memory or register. In the first weft insertion, the length of the yarn wound on the drum 5 is zero (0). In this case, first N=1 is selected, and it is detected whether or not the yarn is jetted in the first weft insertion. If the yarn is jetted, then N=1 is inputted in a programmable frequency division circuit (i.e. the 1/N frequency division circuits 28 and 29). If the yarn is not jetted, then N is compared with the upper limit value. If N is smaller than the upper limit value, then the next data is read to increase the value N, and the loop is followed back; that is, it is determined again whether or not the yarn is jetted.

For instance in the case where the yarn is jetted at the third time, the loop is followed twice, and "3" is outputted as the N.

The upper limit value for N is to eliminate the difficulty that N becomes excessively large when the yarn is not jetted so many times. If the upper limit value is set to "6" for instance, then when the number of times of non-jetting is "6" or larger. "6" is outputted six times, and "0" is outputted until the yarn is jetted thereafter.

When, in the step of calculating the length of the yarn wound on the drum, N is smaller than a, then N is outputted as it is. For instance in the case where the number of times of non-jetting is "2", then "3" is outputted three times. If N=a, then "0" is outputted. This corresponds to the case where N is equal to the upper limit value mentioned above.

The above-described operations are carried for each of the storing units. If the program language is the assembler language, then the operations can be achieved in an extremely short period of time, 1 msec or shorter, for instance by a 80-series CPU. When N has been completely obtained, the value of N is applied to the programmable frequency division circuit with predetermined timing with the aid of the latch signal, and the frequency division is started.

The operation of the drive circuit III, and the software of the microcomputer forming the rotation control circuit II are as described above, and the specific features thereof are as follows:

(1) The number of pulses per revolution generated by the spindle encoder mounted on the spindle of the loom V is a times the number of pulses per revolution outputted by the arm shaft encoder mounted on the arm shaft of the storing unit, where a is (weaving width/drum's circumferential length).

(2) In order to switch the value N, the pulse signal provided by the spindle encoder is subjected to frequency division by the programmable frequency division circuit (1/N frequency division circuit).

(3) The difference between the pulse signals outputted by the spindle encoder and the arm shaft encoder is calculated by the up-down counter, and the output signal of the up-down counter is used as an input signal to the servo motor.

(4) The microprocessor operates to input and store the jetting order, to calculate the value N, and to apply the value N to the programmable frequency division circuit. The value N is switched upon inputting of the signal Z outputted by the spindle encoder.

(5) When N=O, a circuit for inhibiting the application of the spindle encoder pulse to the counter is operated to stop the arm shaft.

(6) The output value N is based on (the number of times of non-selection+1) of each storing unit. The outputting of N=O in the step of calculating the length of the yarn wound on the drum is to prevent the difficulty that N becomes excessively large.

One modification of the first embodiment, in which software is employed for part of the drive circuit, will be described.

The drive circuit shown in FIG. 10 employs a digital servo control system known as "a deviation counter system". A control system of this type can be included in its entirety in the software of a microprocessor. In this case, the dynamic gain setting operation, or highly flexible control such as learning control which is rather difficult for a hardware circuit to achieve can be readily accomplished. Such a servo system is called "a software servo system", and its hardware arrangement is as shown in FIG. 12.

Figure 12:
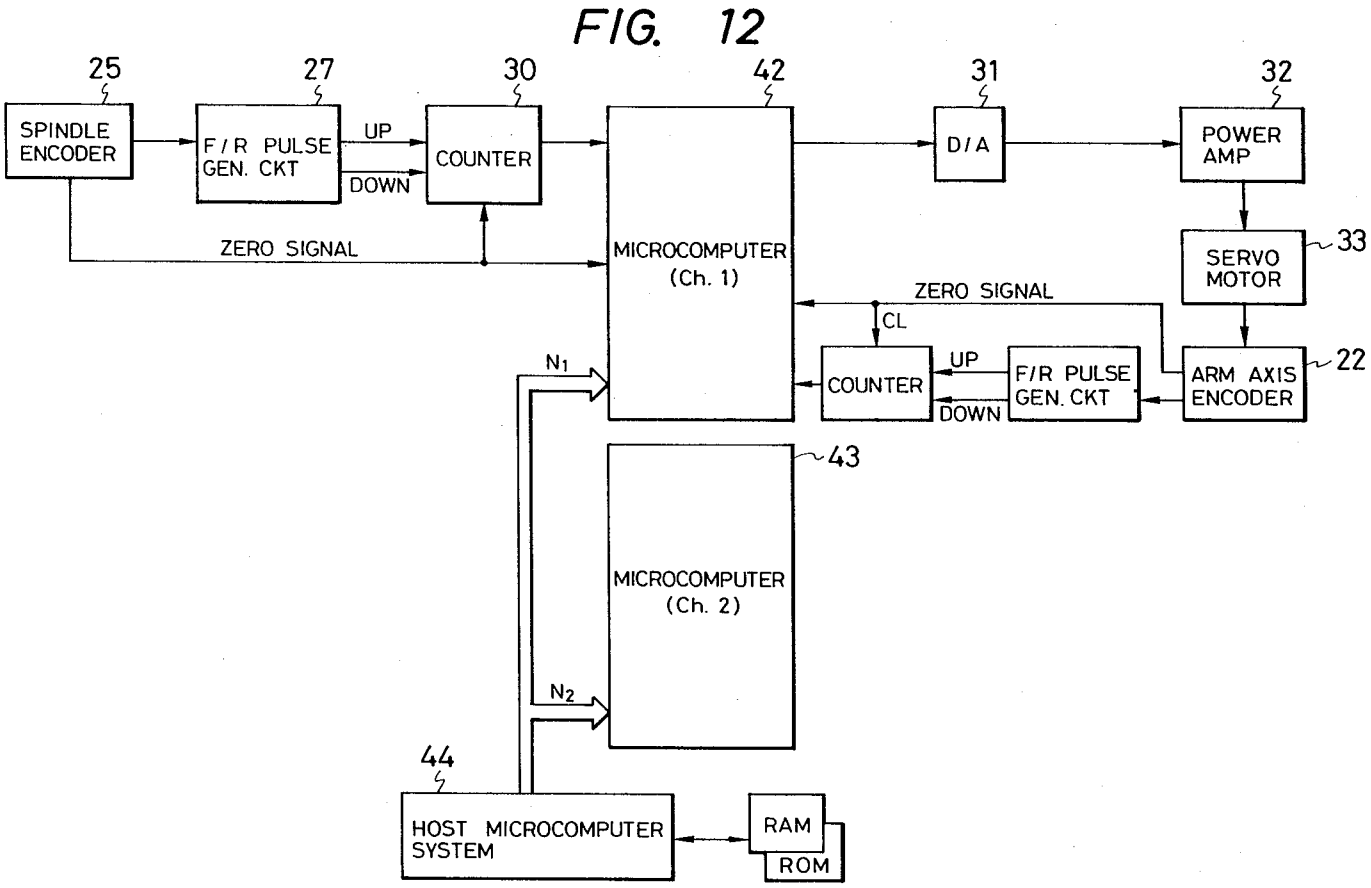
FIG. 12 is a block diagram showing a control system in another embodiment of the invention.

In FIG. 12, a microcomputer 44 operates to input, store and output the value N, and has a so-called "host function" to control microcomputers 42 and 43 coupled to the microcomputer 44. In each of the storing units, a servo controlling microcomputer is provided so that, according to the data N transmitted from the host computer, the values of the encoders are read, and the rotation command value is applied through the D/A converter to the motor. In FIG. 12, the circuit shown in FIG. 9 is provided in the form of software, and the microcomputer 42 carries out the zero decision, 1/N frequency division, counter operation, and latch operation. The effects of the modification reside in an improvement of the circuit reliability, and a simplification of the maintenance, since the circuit has been simplified.

With respect to the control circuit for realizing the (1/N+O) system, the deviation counter system, and its modification, namely, the soft servo system have been described.

Figure 13:
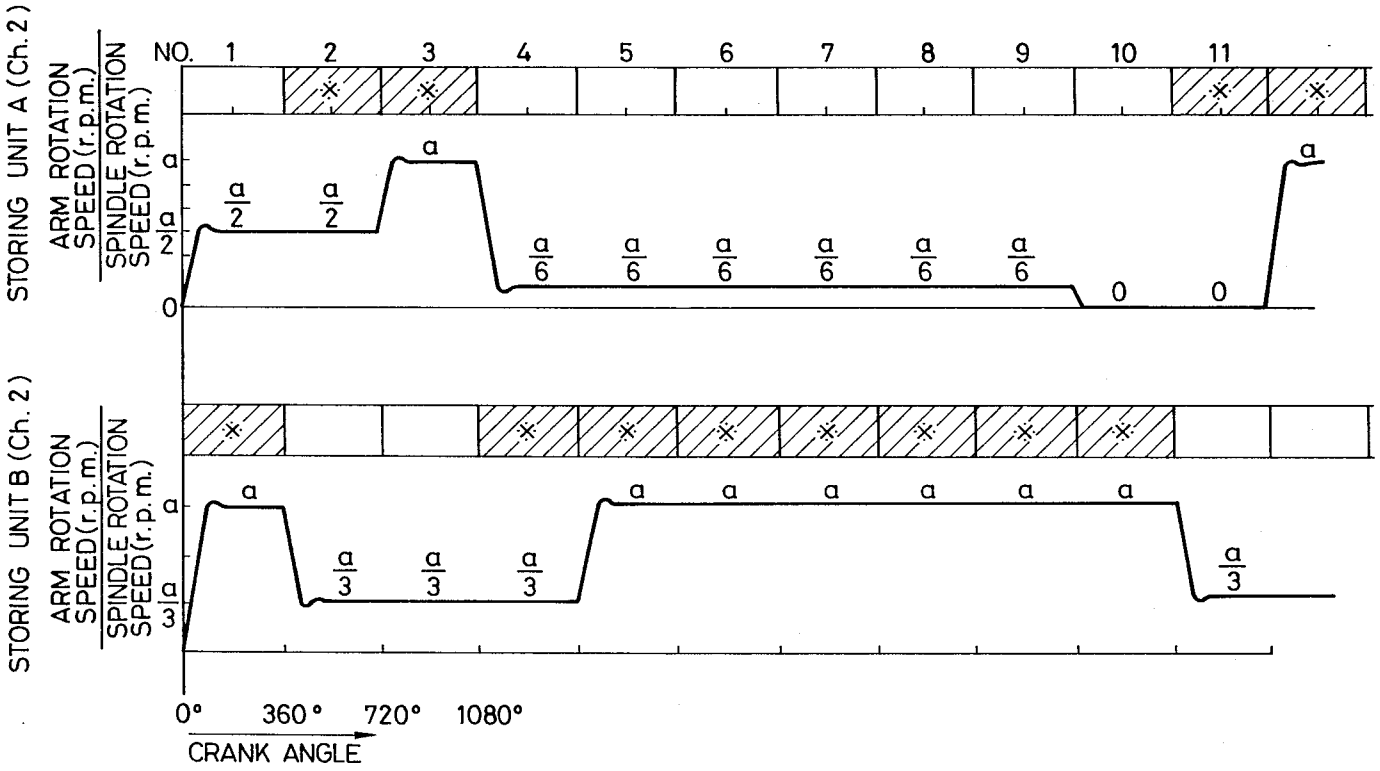
FIG. 13 is a graphical representation indicating rotational conditions of the weft yarn drive shafts of weft yarn storing units with respect to rotational conditions of the spindle of a loom in the embodiment of FIG. 12.

FIG. 13 is a graphical representation indicating arm rotation speed variations in the above-described embodiment with the vertical axis for the ratios of arm shaft rotation speeds to spindle rotation speeds and with the horizontal axis for jetting numbers. As is shown in the gaphical representation, the weft yarn jetting order is B, A, A, B, B, B, B, B, B, B, A and A, and the arm rotation speed suffers from a transient condition due to the delay in servo response.

Figure 14:
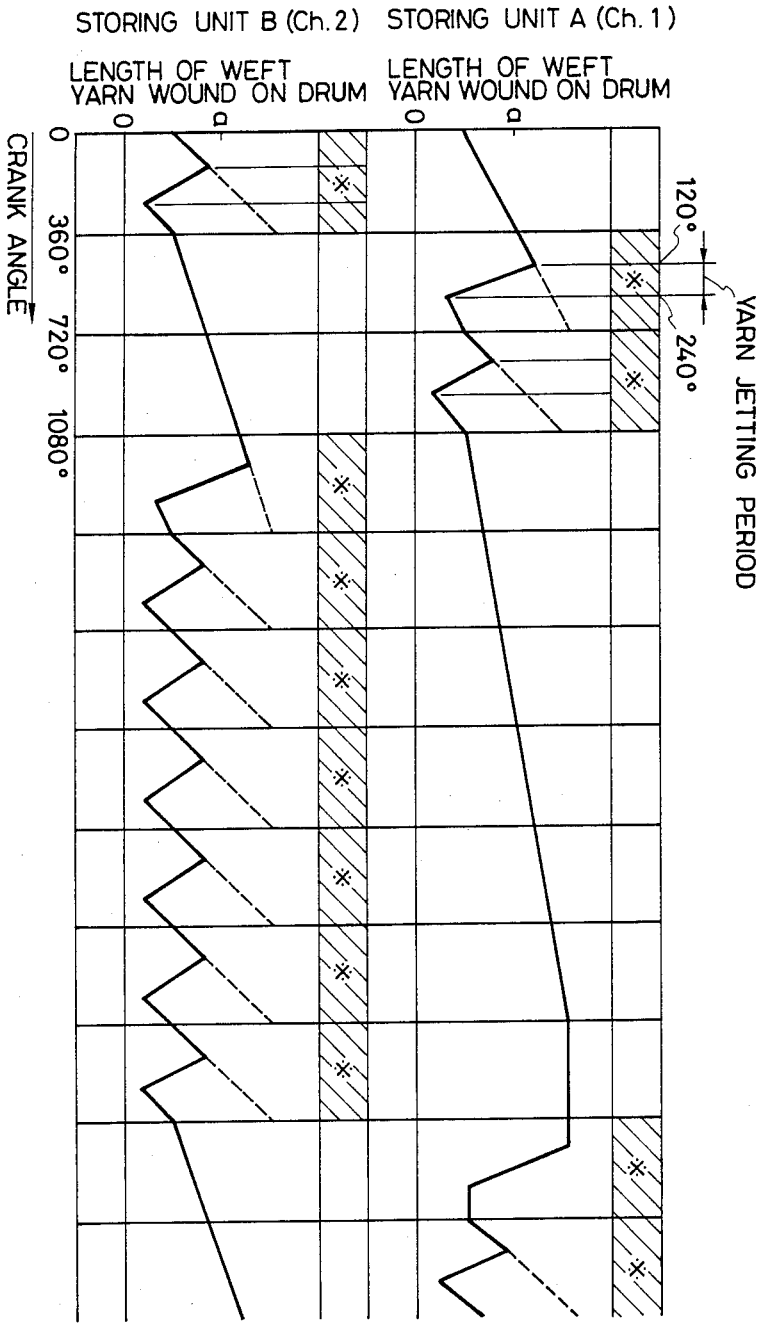
FIG. 14 is also a graphical representation indicating lengths of weft yarns wound in the weft yarn storing units with respect to rotational conditions of the spindle in the embodiment of FIG. 12.

FIG. 14 is also a graphical representation indicating variations in the length of the weft yarn wound on the drum with the vertical axis for the lengths of the yarn wound on the drum and the horizontal axis for the crank angles of the loom spindle. As is apparent from FIG. 14, the yarn jetting operation is carried out when the crank angle is in a range of 120° to 240°.

As was described before, the yarn jetting operation is controlled with the pin 6 shown in FIG. 6. The pin 6 stops the unwinding of the weft yarn from the drum when the length of the weft yarn corresponding to the weaving width has been unwound from the drum. The timing of stopping the unwinding of the weft yarn can be determined according to a conventional method in which the timing is determined from a yarn unwinding speed measured in advance or by using a sensor which is provided near the drum to detect the number of times of yarn unwinding, or a method in which two pins are used.

SECOND EMBODIMENT

The specific features of the second embodiment reside in that a pulse motor is used as the drive means, a circuit for alloting a weft yarn length corresponding to n weft insertions (n>1) is employed as the rotation control circuit, and a circuit of open loop control system is used as the drive circuit.

The arrangement of the second embodiment is as shown in FIG. 15. An encoder 25 for generating digital pulses is mounted on the loom body V. The encoder 25 is connected through a multiplying circuit 45 and a frequency division circuit 46 to a pulse motor drive circuit 47 adapted to drive a pulse motor 48. The multiplying circuit 45 and the frequency division circuit 46 are controlled by a microcomputer 49.

In the multiplying circuit 45, the number of pulses outputted by the encoder 25 is multiplied by an integer. In contrast, in the frequency division circuit 46, the number of pulses is divided by an integer. If these ratios are represented by $N_1$ and $N_2$, respectively, then as the output pulse passes through the two circuits 45 and 46, the pulse frequency of the encoder 25 is converted into $N_1/N_2$. $N_1$ is the number of set storing cycles, and $N_2$ is the sum of the set storing cycles and the standby cycles. Thus, $N_1$ and $N_2$ are determined by the weaving pattern, an example of which is described below.

In the embodiment, a yarn length corresponding to integer weft insertions is alloted. The rotation control circuit II comprises a microcomputer, and the operation of allotment software will be described. For simplification in description, it is assumed that two storing units A and B jet weft yarns in the order of B, A, A, B, B, B, B, B, B, B, A, A, B, A, B, A, . . . , and weft yarns for two weft insertions are stored in the storing units A and B. In the yarn jetting order, the character "A" means that the weft yarn of the storing unit A is selected so as to be jetted, and similarly the character "B" means that the weft yarn of the storing unit B is selected so as to be jetted. In the case of the storing unit A, its weft yarn is not selected for the first cycle of weft insertion, but it is selected for the second and third cycles. Therefore, if the weft yarn long enough for two weft insertions is stored, then the storing unit can be ready for the third cycle. That is, in the first, second and third cycles, the weft yarn length $\frac{2}{3}$ of the weaving width is alloted.

If the weaving width is represented by l, then the allotment of the wound weft yarn lengths is as indicated in FIG. 16. In the 11th and 12th cycles, the weft yarn is selected. Therefore, similarly, in the 4th through 12th cycles, the wound weft yarn length alloted is 2l/9. That is, the specific feature of the first embodiment resides in that a weaving width is alloted to (Si+1) cycles where Si is the number of non-jetting cycles between jetting cycles, while the specific feature of the second embodiment resides in that a length of weft yarn to be stored is longer than l such as 2l, 3l, 4l, and so on is alloted to integer cycles, such as 2, 3, 4, and so on. For example a yarn length for two weft insertions is alloted to two adjacent sets of non-jetting cycles plus two cycles.

If, in FIG. 15, the number of pulses per revolution of the loom body is m, and the pulse motor is so coupled to the storing unit that, with respect to m pulses, the storing unit stores the yarn whose length is exactly equal to the weaving width l, then the storing speed is doubled when the number of pulses is doubled by the multiplying circuit 45, and the storing speed is decreased to half ($\frac{1}{2}$) when a $\frac{1}{2}$ frequency division is effected by the frequency division circuit 46.

The second embodiment has effects that, as the pulse motor is employed as the drive means, the feedback control is eliminated with the result that the circuit is simplified as much, and the speed of the drive means is averaged so that the frequency of acceleration and deceleration is smaller than that in the first embodiment, and therefore the frequency of cutting of yarns, which attributes to the abrupt change of the storing speed, is decreased. In addition, the decrease of the frequency of motor acceleration and deceleration contributes to an increase of the service life of the device, and to a decrease of the power consumption of the motor.

However, since the length of the weft yarn stored is increased, the frequency of occurrence of a trouble that, for instance, the yarns are tangled with each other is increased as much. Therefore, the increase of the length of the weft yarn to be stored should be limited to a certain value.

THIRD EMBODIMENT

In the case where the speed of the spindle of the loom is high, and the number of weft yarns different in color is small, the yarn control response should be high. On the other hand, in the case where spindle speed is low, and the number of weft yarns different in color is large, the yarn control response may be low. Therefore, in this case, naturally it is required to decrease the manufacturing cost per weft yarn. However, this requirement cannot be satisfied by the first and second embodiments. A third embodiment of the invention is intended to satisfy the requirement.

In the first and second embodiments, the drive circuit is of the position control system. The specific features of the third embodiment resides in that a speed control system is employed in which a speed signal is used as the amount of rotation of the loom body, and a speed change gear is employed as its drive means.

The operation of the third embodiment will be described with reference to FIG. 17. A tachometer generator 51 for providing an analog signal according to a speed of rotation is installed on the loom spindle. The signal is rectified and is then applied to a programmable attenuator 52, to provide a command for the drive means. On the other hand, a tachometer generator 53 is installed on a roller shaft (not shown) for feeding a weft yarn into an air pool (not shown), and its output is multiplied by a predetermined gain to provide a feedback signal. According to the difference between the two signals, the lever of the speed change gear 54 is operated by a solenoid so that the speed change ratio is changed stepwise.

If the attenuator 52 is so adjusted that when the switch "1" of the attenuator 52 is operated the roller rotates so that the yarn length per cycle in the air pool corresponds just to the weaving width l, when the switch "2" is operated the yarn length per cycle is a half ($\frac{1}{2}$) of the weaving width, then the N calculating means and the command means in the first and second embodiments can be used as they are except for the N switching section.

In the case of an air pool type storing unit, jetting the weft yarn is regulated by a gripper. Therefore, the length of the weft yarn jetted in the warp shed is that which is fed into the pool for the period of time which elapses from the time instant the gripper is opened until the gripper is closed. Accordingly, it is necessary that the N switching timing coincides with the gripper closing timing. If the former is not in coincidence with the latter, the measured lengths become irregular. As is apparent from FIG. 17, the third embodiment is of the speed control system. Therefore, even if the error of the speed detector is small or the delay in response of the drive means is small, the error or the delay is integrated, with the result that the measured lengths are erroneous.

Figure 17:
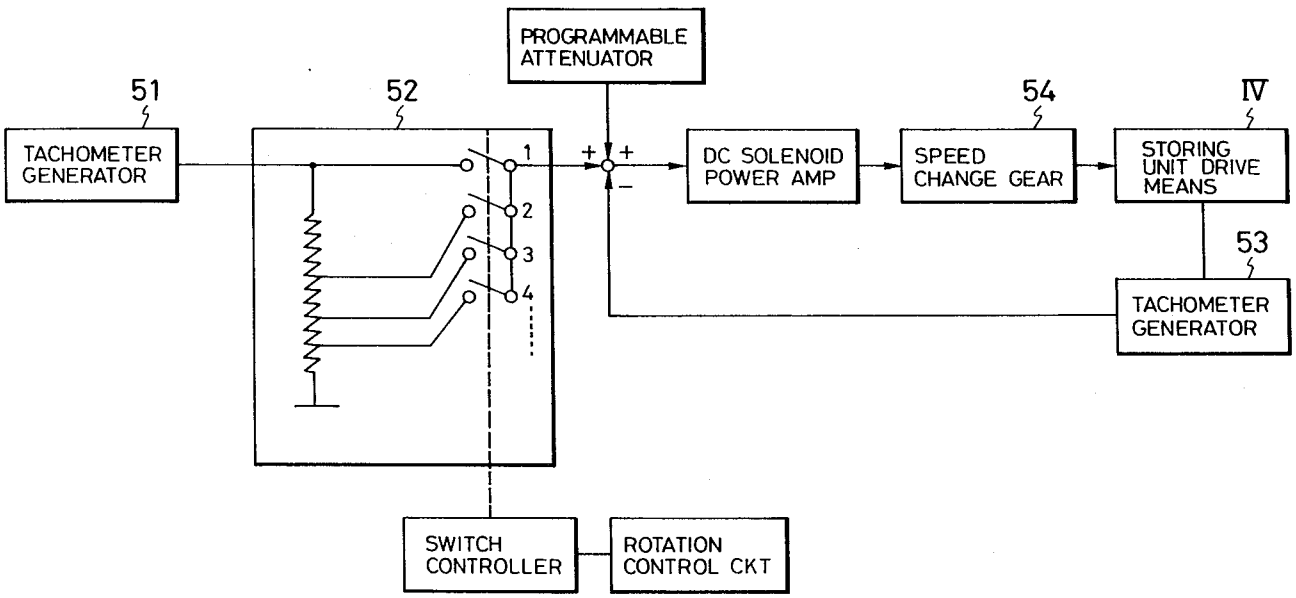
FIG. 17 is a block diagram showing a control system in the other embodiment of the inventionl.

Accordingly, in the case where an accurate operation is required, it is desirable that a correction signal for a measured-length error is applied by the position correction circuit, as shown in FIG. 17. As for the correction signal, a calculation is carried out by utilizing a jetted yarn length detecting means provided at the weaving end or a yarn length detecting means in the air pool, and if the measured length is shorter than a predetermined value, then a minus signal is added, and if it is longer, then a plus signal is added. If, in FIG. 17, instead of the tachometer generators 51 and 53 the aforementioned encoder is used to generate an electrical pulse signal, and the electrical pulse signal thus generated is subjected to F/V (frequency-to-voltage) conversion, then the speed signal can be obtained. However, in the case of obtaining the speed signal by differentiating the position signal, an error may be increased especially when the speed is low. If the detector is adapted to output the position signal, then the control system in FIG. 17 should be formed as a position control system. The speed control system should be on the premise by all means that the speed signal is high in accuracy and the drive means is high in response.

A variety of mechanical speed changers such as a ring type speed changer, cone type speed changer, belt type speed changer and "Zeromax" type speed changer are available as the speed changer 54, and according to the response characteristics and accuracies thereof the measured lengths are variable in accuracy. On the other hand, the electrical speed change mechanism can be realized by using a frequency inverter, a powder clutch or the like. However, a high response characteristic cannot be expected for these speed changers, and accordingly the range of application of the latter is limited. The effect of the third embodiment resides in its economical operation. As the servo system is formed by using the mechanical system instead of the electrical system, the resultant system is substantially free from electromagnetic noise and high in reliability.

The arrangements and the specific features of the first through third embodiments have been described; however, it goes without saying that the arrangements may be modified in various manners. Now, the essential elements in the arrangement will be generally described. The detecting device for detecting condition data, preferably a crank angle is provided for the loom body. Examples of the detecting device are as follows:

(1) An optical encoder, (2) Combination of a gear and a proximity switch or magnetic resistance element, (3) Resolver, (4) Potentiometer, (5) Tachometer generator, (6) Position or speed sensor.

The detecting device provided for the storing unit is the same as the above-described detecting device. For the detecting device, it is preferable to employ an encoder which converts one revolution into a pulse train, more preferably an encoder which converts one revolution into two pulse trains having a phase difference of 90°.

In the air pool type storing unit, the speed of rotation or the amount of rotation of the feed roller is controlled. in the drum type storing unit, the speed or angle of rotation of the arm and/or the speed or angle of rotation of the drum is controlled.

Examples of the drive means are (1) an electric motor, (2) pneumatic motor, (3) mechanical speed changer, (4) hydraulic speed changer, (5) electromagnetic speed changer (powder clutch), and (6) actuator.

Any combination of each element of detecting device, storing unit and drive means can theoretically realize the above-described operation; however, it is preferable to employ an electric servo motor excellent in response characteristic, durability and control characteristic. The required operation can be achieved by using a speed changer as the actuator and by controlling the speed change ratio; however, the method is inferior in response to a method of using an electric motor. In principle, both the open control and the feedback control can be utilized for the control system. However, it is not suitable to employ the open control except for the case where, as in the case of a pulse motor, predetermined accuracy can be maintained with an open loop; that is, it is preferable to employ the feedback control. In the latter case, high accuracy can be expected.

It is preferable to employ an electrical circuit as the rotation control circuit. In this connection, a digital circuit is higher both in accuracy and in reliability than an analog circuit. In the case where the position signal of the loom body is outputted in the form of a pulse train, and the frequency of the pulse train is subjected to 1/N frequency division for the operating section, it is possible to use a method in which pulse trains different in frequency division ratio ($1/N_1$, $1/N_2$, $1/N_3$, . . . ) are formed in advance, and are selectively used by means of a switching element, or a method in which a frequency division ratio N is set by a program divider IC. Furthermore, if a feedback loop is formed as the control system, then an N-multiply circuit can be provided in the feedback loop.

In the case of the analog system, an attenuator is employed instead of the frequency division circuit of the digital system, and an amplifier is employed instead of the multiply circuit. In order to switch the frequency division ratio N, an analog multiplexer or programmable gain amplifier can be used. Similarly as in the case of the digital system, the N switching device is controlled by the switching instructing device. It is preferable that the switching command device is formed by using a microcomputer; however, instead of the microcomputer, a hard logic circuit or programmable sequence circuit can be employed in the case where the range of combination of jetting operations is small, and the jetting order is regular in accordance with the constant pattern to some extent. In order to store the jetting order in the switching instructing device, it is possible to use a variety of media such as tapes, cards, boards, RAM's and ROM's.

EFFECTS OF THE INVENTION

According to the invention, the weft yarn storing unit stores a weft yarn long enough for weft insertion correctly and rationally in synchronization with the operation of the loom. The effects are as follows:

(1) Economical storing means: The weft yarn storing unit of the invention is smoother in yarn storing operation that a conventional one, and is so controlled that the frequency of acceleration and deceleration is decreased. Therefore, the load applied to the drive means is small. Accordingly, the drive means can be made small both in size and in weight, and is long in service life.

(2) Effect of preventing a weft yarn from cutting: As the storing operation is smooth, the tension applied to the weft yarn is less variable. Therefore, the frequency of cutting or damaging the weft yarn is low.

(3) Improvement of the operability: According to the invention, the storing unit is controlled according to the rotation signal of the loom body, and therefore the operation of the storing unit is synchronous with that of the loom body. Therefore, even when the number of revolutions per minute of the loom body is changed, no adjustment is required. Thus, the operability is much higher than that of the conventional storing unit.

(4) Improvement of the reliability: It is possible to limit the length of a weft yarn stored in the storing unit to a value corresponding to one pick. In the storing unit, when compared with a conventional one, the frequency of occurrence of a trouble that the weft yarn is overlapped when wound is small. In addition, it is unnecessary to detect the length of a weft yarn stored. Thus, the storing unit is considerably high in reliability.

Control with high accuracy is essential for a storing operation high in accuracy. In the fourth aspect of the invention, a digital system is employed for processing signals in the control system, to prevent the occurrence of errors such as drift. More specifically, optical encoders or digital pulse generators comprising magnetic resistance elements and magnetic elements can be employed as means for detecting the amount of rotation of the loom and means for detecting the amount of rotation of the storing means, and, for the frequency conversion of pulse signal output by the digital pulse generators, a digital frequency division or multiply circuit can be provided in the device circuit.

Example of the drive means for the storing unit are preferably electric motors such as a pulse motor, DC servo motor and AC servo motor; however, a pneumatic motor or hydraulic motor can be used for a low speed operation of the drive means. Furthermore, an induction motor can be controlled by using an inverter (frequency converting means). For the low speed operation, in addition to the motor, a mechanical speed changer such as a friction wheel type infinitely variable speed changer, V-belt type infinitely variable speed changer, chain-type infinitely variable speed changer or one-way clutch type infinitely variable speed changer, or a hydraulic speed changer can be employed. it goes without saying that the storing characteristic depends on the performance of the motor or speed changer selected.

What is claimed is:

1. A control device for controlling the storage amount of a selected weft yarn in a storage device for a jet loom having a plurality of weft yarn storing units wherein a plurality of weft yarns are stored in respective weft yarn storing units according to weaving pattern command signals produced by a command means, and in the weft insertion cycle of each weft yarn storing unit, the weft yarn stored therein is jetted to the loom to perform a weft insertion, comprising:

rotation detecting means for detecting a rotational condition of the driving shaft of a loom body, to output a driving shaft rotation signal;

a rotation control circuit which, according to a weft yarn jetting order command signal, calculates the numbers of standby cycles between weft insertion cycles of said weft yarn storing units, and calculates the speeds of rotation of weft yarn storing sections in said weft yarn storing units to store weft yarns for weft insertion in advance according to the numbers of standby cycles thus calculated, to produce rotation command signals;

a driving circuit for receiving the driving shaft rotation signal from said rotation detecting means and the rotation command signals from said rotation control circuit, to produce drive signals to determine the speeds of rotation of said weft yarn storing units; and drive means provided for said weft yarn storing units, respectively, each drive means receiving the drive signal from said drive circuit to drive a respective weft yarn storing unit at a speed of rotation corresponding to said drive signal thus received, a weft yarn having a length corresponding to a predetermined weft insertion length being stored in said weft yarn storing units in weft insertion cycles selected according to said weft yarn jetting order command signal.

2. A device as claimed in claim 1, wherein said rotation control circuit calculates, in the case where a weft insertion length corresponding to a weaving width of said loom is represented by l, the number of set storing cycles is represented by n (n being an integer larger than zero) and the calculated number of standby cycles of a weft yarn storing unit is represented by Si, the speed of rotation of a weft yarn drive section of the weft yarn storing unit which uniformly allots a weft yarn length nl stored before the following weft insertion over cycles which are determined from the sum $$\left(\sum_{i=1}^{n} Si + n\right)$$

of the number of standby cycles and the number of set storing cycles, to output a said rotation command signal.

3. A device as claimed in claim 2, wherein said rotation control circuit, when said sum $$\left(\sum_{i=1}^{n} Si + n\right)$$

exceeds a predetermined upper limit S' of cycles for uniform allotment, calculates and outputs the speeds of rotation of the weft yarn storing units which store said weft yarn lengths nl in the weft yarn storing sections thereof during S' cycles, and after said S' cycles, outputs signals to stop the weft yarn drive sections thereof.

4. A device as claimed in claim 3, wherein said rotation detecting means comprises a shaft encoder which is coupled through rotation to the driving shaft of said loom body and the spindles of the weft yarn storing sections of said weft yarn storing units, to generate an electrical pulse for every predetermined angular rotation of said driving shaft and each spindle, said drive circuit comprises a control circuit for converting the frequency of a pulse signal from said shaft encoder, to control the speeds of rotation of said weft yarn storing units, and said rotation control circuit controls the frequency conversion ratio of said drive circuit according to said rotation command signal based on said weft yarn jetting order command signal.

5. A device as claimed in claim 1, which further comprises rotational detecting means for detecting the condition of the weft yarn storing units to output a weft yarn storing signal wherein said drive circuit further comprises comparing means for comparing said drive shaft rotation signal with said weft storing signal, and controlling means for controlling said weft yarn storing units by outputting the difference between said two signals in such a manner that a weft yarn having a predetermined weft insertion length is stored in cycles selected by a weft yarn jetting order signal stored in a memory provided in said rotation control circuit.

6. A device as claimed in claim 1, wherein said rotation control circuit comprises:

a jetting order command circuit for outputting signals of weft yarn jetting order command, a standby cycle calculating circuit calculating the numbers of standby cycles between weft insertion cycles of said weft yarn storing units according to a weft yarn jetting order command signal, and a calculating circuit of rotation command amount for calculating the speeds of rotation of weft yarn storing sections in said weft yarn storing units to store weft yarns for weft insertion in advance according to the numbers of standby cycles thus calculated.

7. A device as claimed in claim 6, wherein said drive means comprises a pulse motor.

8. A device as claimed in claim 6, wherein said drive circuit comprises a circuit of open loop control system.

9. A device as claimed in claim 6, wherein said rotation detecting means comprises an optical rotary encoder provided on said loom body.

10. A device as claimed in claim 6, wherein said drive means comprises a pulse motor, said rotation control circuit comprises a circuit for alloting a weft yarn length corresponding to n weft insertion ($n>1$), and said drive circuit comprises a circuit of open loop control system.

11. A device as claimed in claim 1, wherein said storing units comprise a plurality of drum type storing units, said rotation detecting means for detecting the rotational condition of the drive shaft of a loom body comprises an optical rotary encoder said rotation control circuit comprises a microcomputer used to produced a rotation command signal for each storing means, and to subject the rotation command encoder signals to frequency division.

* * * * *